US009797060B2

(12) United States Patent
Du et al.

(10) Patent No.: US 9,797,060 B2
(45) Date of Patent: Oct. 24, 2017

(54) NANOSTRUCTURED SAPPHIRE OPTICAL FIBER SENSING PLATFORM

(71) Applicant: The Trustees of the Stevens Institute of Technology, Hoboken, NJ (US)

(72) Inventors: Henry Du, Short Hills, NJ (US); Hui Chen, Rutherford, NJ (US); Fei Tian, Lyndhurst, NJ (US)

(73) Assignee: THE TRUSTEES OF THE STEVENS INSTITUTE OF TECHNOLOGY, Hoboken, NJ (US)

( * ) Notice: Subject to any disclaimer, the term of this patent is extended or adjusted under 35 U.S.C. 154(b) by 144 days.

(21) Appl. No.: 14/680,326

(22) Filed: Apr. 7, 2015

(65) Prior Publication Data

US 2016/0298253 A1 Oct. 13, 2016

Related U.S. Application Data

(60) Provisional application No. 61/977,452, filed on Apr. 9, 2014.

(51) Int. Cl.

| | |
|---|---|
| ***C25D 11/24*** | (2006.01) |
| ***C25D 11/18*** | (2006.01) |
| ***C25D 11/04*** | (2006.01) |
| ***C23C 18/44*** | (2006.01) |
| ***C23C 18/54*** | (2006.01) |
| ***C23C 18/18*** | (2006.01) |
| ***C25D 11/08*** | (2006.01) |
| ***C23C 18/16*** | (2006.01) |
| ***C23C 18/42*** | (2006.01) |

(52) U.S. Cl.

CPC ..... *C25D 11/24* (2013.01); *C23C 18/1639* (2013.01); *C23C 18/1879* (2013.01); *C23C 18/42* (2013.01); *C25D 11/045* (2013.01); *C25D 11/08* (2013.01); *C25D 11/18* (2013.01)

(58) Field of Classification Search

CPC ..... C25D 11/24; C25D 11/18
USPC ..... 205/173, 201–203
See application file for complete search history.

(56) References Cited

U.S. PATENT DOCUMENTS

| | | | | |
|---|---|---|---|---|
| 2006/0038990 | A1* | 2/2006 | Habib | G01N 21/658 356/301 |
| 2007/0020144 | A1 | 1/2007 | Du et al. | |
| 2013/0143230 | A1 | 6/2013 | Tolias et al. | |

OTHER PUBLICATIONS

Bates; High Temperature Sapphire Fiber Cladding; Available at: http://www.tvu.com/PSFOCladweb.html; (Sep. 25, 2012); printed Jul. 7, 2015; 9 pages.

Chang et al.; In situ growth of silver nanoparticles in porous membranes for surface-enhanced Raman scattering. ACS Applied Materials & Interfaces; vol. 2, No. 11; (Nov. 2, 2010) pp. 3333-3339.

Chen et al.; Advantage of multi-mode sapphire optical fiber for evanescent-field SERS sensing; Optics Letters; vol. 39, No. 20 (Oct. 6, 2014) pp. 5822-5825.

(Continued)

*Primary Examiner* — Brian W Cohen
(74) *Attorney, Agent, or Firm* — Greenberg Traurig, LLP

(57) ABSTRACT

A method for fabricating a sensor includes coating an end-polished sapphire fiber with aluminum to produce a sapphire fiber having an aluminum coating, anodizing the aluminum coating to produce an aluminum oxide coating, and removing the aluminum oxide coating from a distal end of the sapphire fiber.

16 Claims, 5 Drawing Sheets

(56) References Cited

OTHER PUBLICATIONS

Chen et al.; A scalable pathway to nanostructured sapphire optical fiber for evanescent-field sensing and beyond; Applied Physics Letters; vol. 106, (Mar. 16, 2015) pp. 111102-1 to 111102-5.
Jiang et al.; Synthesis and characterization of spinel MgAl2O4 thin film as sapphire optical fiber cladding for high temperature applications; Thin Solid Films; 539, (May 17, 2013) pp. 81-87.
Lee et al; Adsorption and surface-enhanced Raman of dyes on silver and gold sols; J. Phys. Chem.; 86, (Apr. 28, 1982) pp. 3391-3395.
Overton; Optical Fiber Sensing: Improved sapphire fibers raise prospects for harsh-environment-sensing; LaserFocusWorld (Aug. 3, 2012), available at: http://www.laserfocusworld.com/articles/print/volume-48/issue-08/world-news/optical-fiber-sensing-improved-sapphire-fibers-raise-prospects-for-harsh-environment-sensing.html; printed Jul. 8, 2015; 7 pages.
Pfeiffenberger et al.; Sapphire photonic crystal fibers; Optical Engineering; vol. 49, (Sep. 2, 2010) pp. 203501-1 to 203501-3.
Spratt et al.; Optical mode confinement and selection in single-crystal sapphire fibers by formation of nanometer scale cavities with hydrogen ion implantation. J. Appl. Phys.; vol. 114, (Nov. 22, 2013) pp. 203501-1 to 203501-7.

* cited by examiner

NANOSTRUCTURED SAPPHIRE OPTICAL FIBER SENSING PLATFORM

STATEMENT REGARDING FEDERALLY SPONSORED RESEARCH

This invention was supported in part by funds from the U.S. government (NSOF ECCS Grant No. 1325367). The U.S. government may therefore have certain rights in the invention.

CROSS-REFERENCE TO RELATED APPLICATION

The present application is a Section 111(a) application relating to and claiming the benefit of commonly owned, co-pending U.S. Provisional Patent Application No. 61/977,452, having a filing date of Apr. 9, 2014, which is incorporated by reference herein in its entirety.

FIELD OF THE INVENTION OR TECHNICAL FIELD

The present invention generally relates to optical fibers, and, more specifically, to nanostructured sapphire optical fibers ("NSOF"), an NSOF sensing platform, and methods for making NSOF and NSOF sensing platforms.

BACKGROUND OF THE INVENTION

Optical fibers have made a significant impact on sensing technologies due to their intrinsic immunity to electromagnetic interference, electrical passivity, high resolution and large dynamic range. An important new class of optical fiber has recently emerged: microstructured optical fibers ("MOF"), which presents new alternatives for a multitude of scientific and technological applications by means of synergistically integrating optics and microfluidics in a single fiber with unprecedented light path length. However, existing fibers are all based on silica, which is inherently unstable in chemically harsh environments at high temperatures. As the demand for advanced systems increases in areas such as aerospace, sustainable energy, military security, and industrial processes, sensor technologies that can function under extreme operating conditions become of critical importance. Sapphire optical fibers offer an excellent alternative due to their known chemical and thermal stability, but microstructured versions cannot be readily made as in the case of silica MOF. Additionally, commercially available and optical-quality sapphire fibers rated for high temperatures are all free of cladding. Unclad sapphire fiber is extremely sensitive to attenuation due to scattering and absorption by particulate deposits and contaminants within a service environment. Further, the ~1.77:1.0 index contrast between sapphire fiber and air in the visible range results in rapid decay of the evanescent field from a fiber surface to its surroundings, limiting the field-analyte overlap for sensing interrogation.

SUMMARY OF THE INVENTION

In an embodiment, a method for fabricating a sensor includes coating an end-polished sapphire fiber with aluminum to produce a sapphire fiber having an aluminum coating, anodizing the aluminum coating to produce an aluminum oxide coating, and removing the aluminum oxide coating from a distal end of the sapphire fiber. In an embodiment, the method also includes immobilizing a plurality of nanoparticles in pores of the porous aluminum oxide coating. In an embodiment, the plurality of nanoparticles includes one of a plurality of silver nanoparticles and a plurality of gold nanoparticles.

In an embodiment, the step of immobilizing the plurality of nanoparticles in pores of the porous aluminum oxide coating includes the steps of immersing the sapphire fiber with porous anodized aluminum oxide coating in a solution of polyallylamine hydrochloride, rinsing the porous aluminum oxide coating in purified water, and immersing the with porous aluminum oxide coating in a suspension of silver nanoparticles. In an embodiment, a concentration of the solution of polyallylamine hydrochloride is about 0.2 milligrams per milliliter. In an embodiment, the step of immobilizing the plurality of nanoparticles in pores of the porous aluminum oxide coating further includes adding a sodium citrate solution to a silver nitrate solution to produce a mixture and exposing the mixture to ultraviolet light for a predetermined time period to produce the solution of silver nanoparticles. In an embodiment, the sodium citrate solution includes 0.8 milliliter of 1% aqueous sodium citrate and the silver nitrate solution includes 40 milliliters of 1 millimolar $AgNO_3$. In an embodiment, the predetermined time period is about four hours and the mixture is maintained at a temperature of less than 50 degrees Celsius during the exposing step.

In an embodiment, the step of immobilizing the plurality of nanoparticles in pores of the porous aluminum oxide coating includes the steps of immersing the porous aluminum oxide coating in a solution of tin chloride and hydrochloric acid thereby forming tin deposits in the porous aluminum oxide coating, immersing the porous aluminum oxide coating with the tin deposits in a solution of silver nitrate to produce silver seeds in the porous aluminum oxide coating, and immersing the porous aluminum oxide coating with the silver seeds in a solution of silver nitrate and ascorbic acid thereby forming silver nanoparticles in the porous anodized aluminum oxide coating. In an embodiment, the steps of immersing the porous aluminum oxide coating in a solution of tin chloride and hydrochloric acid and immersing the porous aluminum oxide coating with the tin deposits in a solution of silver nitrate constitute a deposition cycle. In an embodiment, the deposition cycle is repeated for a plurality of deposition cycles prior to immersing the porous anodized aluminum oxide coating with the silver seeds in a solution of silver nitrate and ascorbic acid. In an embodiment, the plurality of deposition cycles comprises five deposition cycles.

In an embodiment, the method also includes selecting a parameter of the anodizing step to control at least one of a size of pores in the porous anodized aluminum oxide coating, a depth of pores in the porous anodized aluminum oxide coating, and an interpore distance between pores in the porous anodized aluminum oxide coating. In an embodiment, the parameter includes one or both of a pH of an electrolyte solution used for the anodizing step and a voltage applied to an electrolyte solution used for the anodizing step.

In an embodiment, the step of coating the end-polished sapphire fiber includes dip-coating the end-polished sapphire fiber in liquid aluminum. In an embodiment, the dip-coating step is performed under an inert atmosphere. In an embodiment, the anodizing step is performed in an acidic electrolyte solution under an applied voltage. In an embodiment, the step of removing the distal end of the porous aluminum oxide coating includes dipping the distal end of the porous aluminum oxide coating in an acidic solution.

In an embodiment, a sensor includes an end-polished sapphire fiber, a porous aluminum oxide coating covering an outer surface of the end-polished sapphire fiber, and a plurality of nanoparticles immobilized in pores of the porous aluminum oxide coating. In an embodiment, the plurality of nanoparticles includes one of a plurality of silver nanoparticles and a plurality of gold nanoparticles.

BRIEF DESCRIPTION OF FIGURES

For a more complete understanding of the present invention, reference is made to the following detailed description of the exemplary embodiments considered in conjunction with the accompanying drawings, in which.

DETAILED DESCRIPTION OF THE INVENTION

Figure 1:
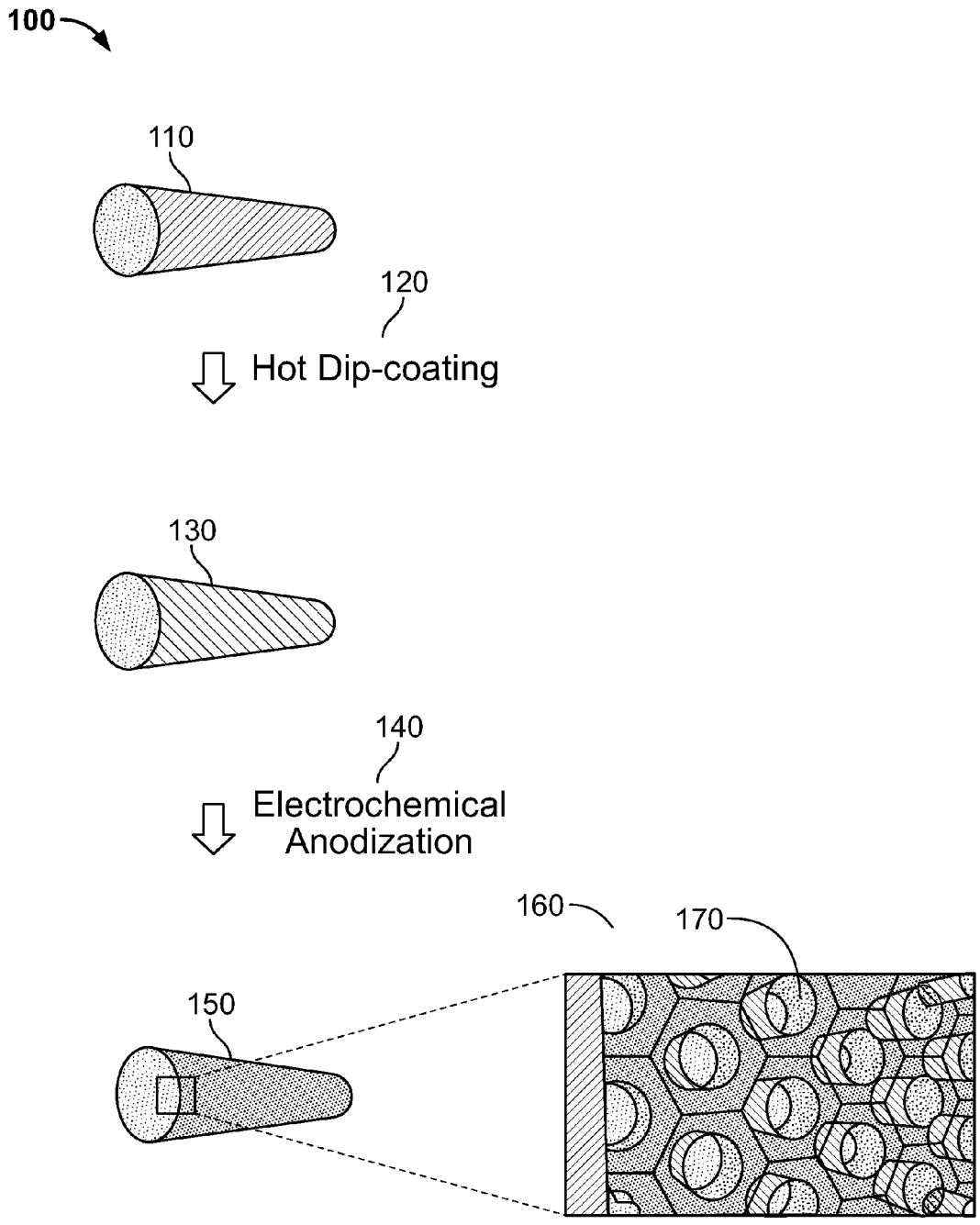
FIG. 1 is a schematic illustration of a fabrication process of NSOF/AAO sensing platform according to an embodiment of the present invention.

The exemplary embodiments of the present invention provide a platform for chemical sensing and measurements in harsh environments at high temperatures. An exemplary sensing platform includes sapphire optical fiber with a nanoporous anodized aluminum oxide ("AAO") cladding. An exemplary fabrication method includes the steps of coating sapphire fiber with a metallic aluminum coating, then electrochemically converting the aluminum metal to nanoporous AAO. The resultant NSOF/AAO sensing platform takes advantage of the tunable optical and structural characteristics of porous AAO with high specific surface area.

Sapphire fiber is inherently multi-mode, which offers advantages for evanescent-field based sensing and measurements attributable to the strong mode-field overlap in the presence of the excitation of higher order modes. AAO serving as sapphire fiber cladding can significantly extend the evanescent field from the surface of the fiber to the cladding with stronger field overlap.

The structure of the exemplary AAO cladding described herein (e.g., pore channel diameter and interpore distance) may be easily tailored to tune optical properties, making it possible to engineer the light propagation through the sapphire fiber. The high specific surface area of the AAO cladding also provides an abundance of molecular adsorption sites and allows rapid access of target analytes for evanescent-field laser spectroscopy interrogation. The AAO cladding may also function as a host and stabilizer of plasmonic nanoparticles, making surface-enhanced Raman scattering ("SERS") measurements at high temperatures possible.

The material similarity between AAO and sapphire (both of which are aluminum oxide materials) preserves the integrity of the exemplary NSOF. Further, the pore size, interpore distance, and pore depth of the exemplary AAO structure can be precisely controlled by varying the parameters of the fabrication process, such as anodization voltage, anodization time, electrolyte concentration, etc. Consequently, a fiber cladding with a desired refractive index can be obtained.

To realize the sensing capability of the exemplary sensor, laser spectroscopy is employed. In one embodiment of the present invention, SERS is used as a sensing modality due to its high sensitivity and specificity. An exemplary SERS signal may be generated by immobilizing the nanoparticles on the AAO structure, thereby enhancing the intensity of Raman signals when molecules are attached to nanoparticles (e.g. silver nanoparticles, gold nanoparticles, etc.). The nanoporous structure of AAO can effectively stabilize silver or gold nanoparticles to prevent their aggregation and Ostwald ripening, thereby preserving their high-temperature SERS activity. Additionally, nanoparticles with high melting temperatures and localized surface plasmon resonance in the ultraviolet ("UV") region, such as palladium nanoparticles or platinum nanoparticles, may be stabilized in the same exemplary structure to produce a high-temperature UV-SERS.

Referring to FIG. 1, a process 100 of fabricating a NSOF/AAO sensing platform according to an exemplary embodiment is illustrated conceptually. The process 100 begins with a sapphire fiber 110. A very thin (e.g., on the order of approximately two microns in thickness) hermetical metal aluminum film is coated 120 onto an end-polished sapphire fiber via hot a dip-coating method under an inert atmosphere, which may be accomplished using methods known in the art. The result of this coating is aluminum-coated sapphire fiber 130. Next, the aluminum-coated sapphire fiber 130 is placed into an anodization unit (e.g., in a vertical orientation) and anodized 140 in an acidic electrolyte solution (e.g., 0.3 M phosphoric acid at 0° C.) under an applied voltage (e.g., 120 V for four hours). The product of these two steps is an exemplary AAO-coated sapphire fiber 150, illustrated in detail in inset 160 to show pores 170. Pore size, interpore distance, and depth of pores within the AAO coating can be precisely controlled by varying the related parameters such as anodization time, anodization voltage, electrolyte pH, electrolyte concentration, etc. For example, a longer anodization time may lead to larger pore size and thicker AAO coating; higher anodization voltage may lead to larger pore size and longer interpore distance; lower pH may lead to lower potential threshold for field-enhancing diffusion at the pore tips, causing smaller pore size. An intended distal end of the resulting fiber may then be dipped into an acidic solution (e.g., hydrochloric acid) to remove residual AAO and expose the polished fiber tip. The result of the above steps is an exemplary NSOF/AAO sensing platform.

Figure 2:
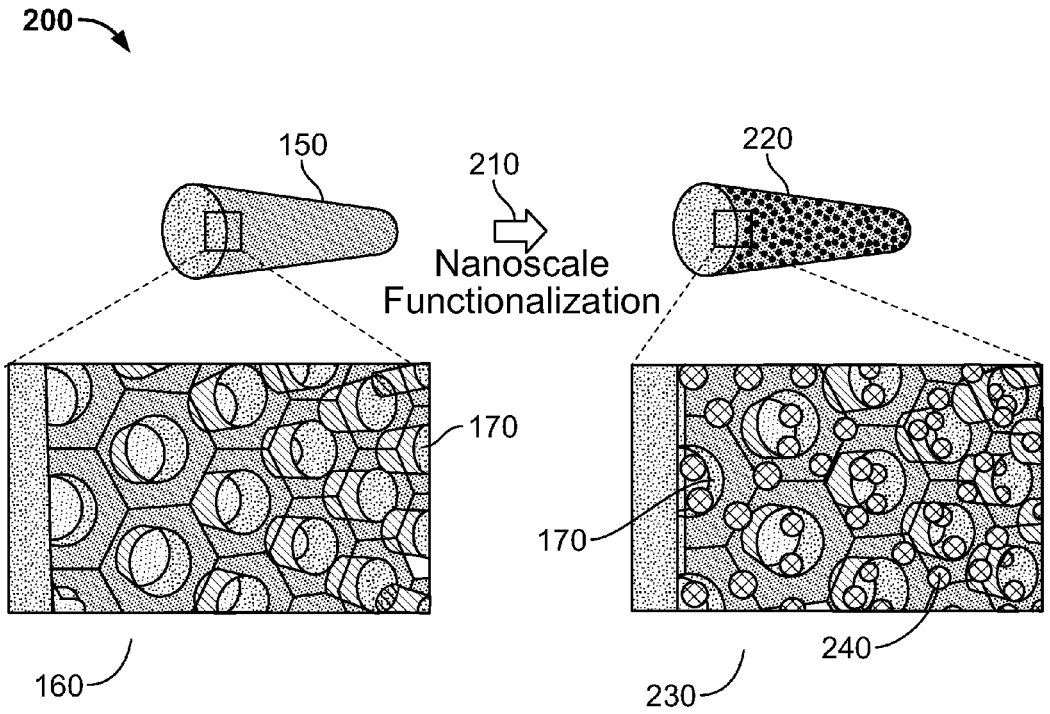
FIG. 2 is a schematic illustration of nanoscale functionalization on the sensing platform of FIG. 1 by decorating Ag nanoparticles on the porous structure of AAO according to an embodiment of the present invention.

Referring now to FIG. 2, an exemplary SERS-active NSOF/AAO sensor may be fabricated through a nanoscale functionalization process according to the process described above with reference to FIG. 1. Silver nanoparticles may be synthesized by a modified Lee-Meisel method. Under such an exemplary method, 1% aqueous sodium citrate (0.8 mL) may be added dropwise to a 40 mL solution of 1 mM $AgNO_3$ under continuous stirring. The mixture may then be transferred into a UV exposure chamber. To avoid locally increased temperature, a water bath may be used to keep the mixture temperature below 50° C. to ensure the quality synthesis of monodispersed silver nanoparticles. The mixture may be exposed to UV radiation using, for example, a UV lamp, with continuous stirring for about 4 hours. The resulting silver nanoparticles may have a ζ-potential of −35 mV with an average particle size of 40±5 nm and a plasmon resonance at 408 nm.

The silver nanoparticles synthesized using the method described above may then become immobilized through electrostatic interactions between a positively-charged polyallylamine hydrochloride ("PAH") surface and negatively charged silver nanoparticles by the following exemplary procedure. The sensing platform (i.e., the NSOF/AAO structure) may first be immersed in a solution of about 0.2 mg $mL^{-1}$ PAH at pH 9 for 20 minutes, and may then be rinsed with purified water at pH 4.5 to remove any free or loosely bound PAH. Silver nanoparticles may subsequently be attached to the PAH-modified sensing platform by immersing the sensing platform in a solution of roughly $10^{12}$ particles $mL^{-1}$ at pH 5.5 for 1 hour.

In another exemplary technique, silver nanoparticles may be incorporated into AAO cladding via in-situ growth from electroless-deposited silver seeds. According to such an exemplary technique, AAO cladding may be immersed in an aqueous mixture of $SnCl_2$ (0.02M) and HCl (0.02M) for 2 minutes, resulting in the deposition of $Sn^{+2}$ on the pore walls. The AAO cladding may then be soaked in 0.02M aqueous $AgNO_3$ solution for 2 minutes to reduce silver seeds. This deposition cycle may be repeated (e.g., for five repetitions) to provide a high coverage density of silver seeds on the pore walls within the AAO cladding. Following the electroless deposition of silver seeds, large and highly concentrated silver nanoparticles may be formed through a heterogeneous nucleation and growth mechanism by immersing the AAO cladding in an aqueous mixture of 10 mM $AgNO_3$ and 100 mM ascorbic acid for 2 hours.

The foregoing exemplary processes may be readily adapted to negatively-charged gold and other metals (e.g., platinum or palladium) useful for SERS analysis by one having ordinary skill in the art and possession of the present disclosure.

Figure 3:
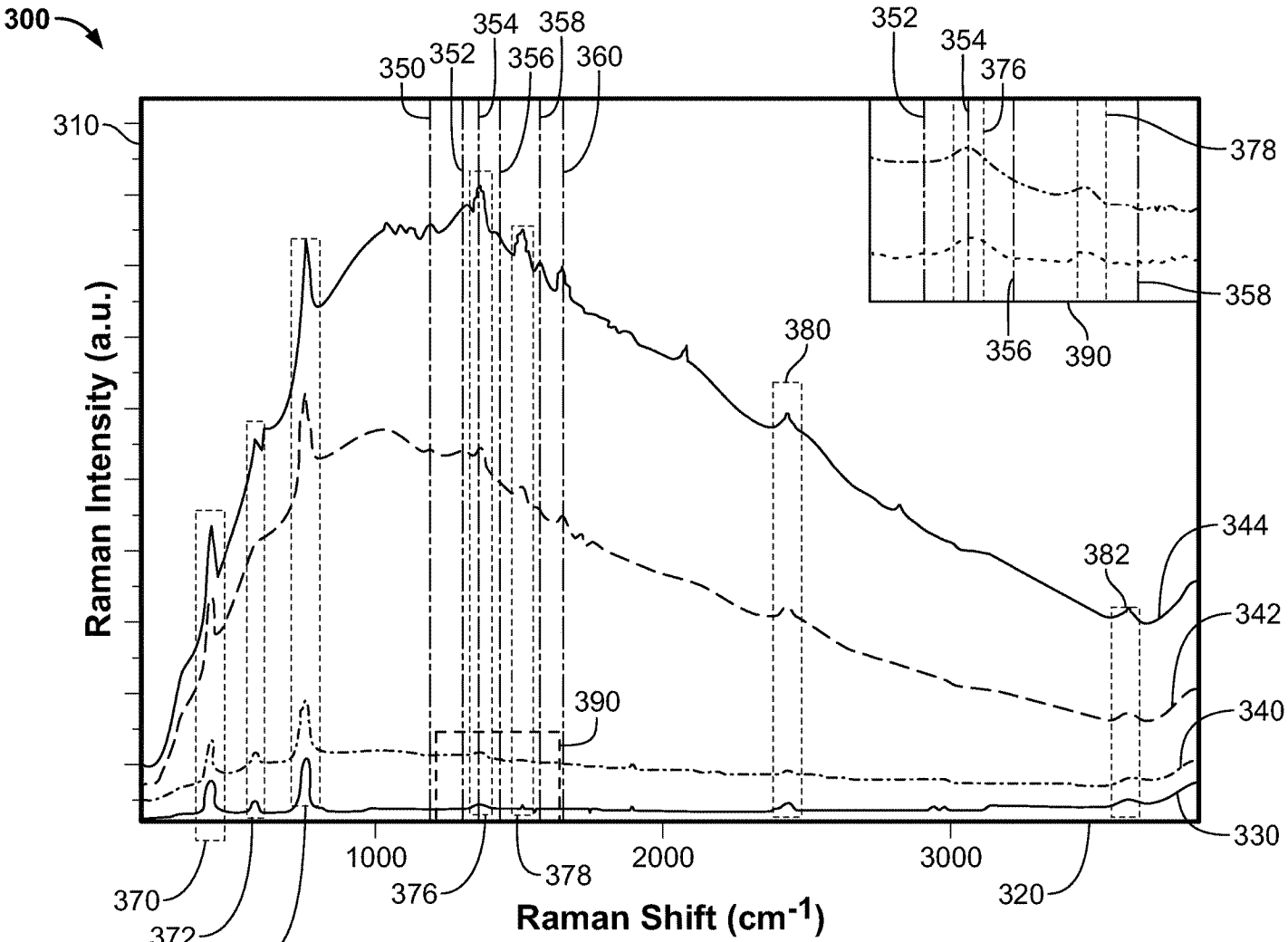
FIG. 3 presents the SERS spectra of water and different concentrations of Rhodamine 6G (R6G) solution using a SERS-active NSOF/AAO sensing platform through the immobilization of as-synthesized Ag nanoparticles in the AAO cladding according to an embodiment of the present invention.

FIG. 3 presents a graph 300 illustrating the effectiveness of an exemplary NSOF/AAO sensing platform based on evanescent-field SERS measurements of the analyte Rhodamine 6G ("R6G") in aqueous solution, as made using an exemplary sensing platform of the present invention. The graph 300 plots Raman intensity, in arbitrary units ("a.u."), along a vertical axis 310 against Raman shift, in $cm^{-1}$, along a horizontal axis 320. The graph 300 includes a baseline SERS spectrum of water 330 measured by the exemplary NSOF/AAO sensing platform. The graph 300 also includes spectra 340, 342 and 344 that were measured with the exemplary NSOF/AAO sensing platform immersed in an aqueous solution of R6G at concentrations of $10^{-7}$M, $10^{-6}$M, and $10^{-5}$M, respectively. It will be known to those of skill in the art that peaks at 1183, 1314, 1363, 1512, 1569, 1652 $cm^{-1}$, represented in the graph 300 by lines 350, 352, 354, 356, 358 and 360, respectively, are associated with characteristic aromatic C—C stretching vibrations of R6G molecules. Each of the spectra 340, 342 and 344 shows Raman lines with frequency shifts 370, 372, 374, 376, 378, 380 and 382 at 423, 583, 756, 1360, 1514, 2438, 3627 $cm^{-1}$, respectively. As illustrated in the inset 390, comparing spectrum 340 to baseline spectrum 330, the R6G vibrational features are evident even at $10^{-7}$ M. The R6G vibrational features become more distinct and intense at the higher R6G concentrations illustrated in plots 342 and 344. The broad background may be attributed to the strong fluorescence of R6G at an excitation wavelength of 532 nm. The intensity of this fluorescence background may enrich with increasing concentrations of the R6G solution.

Figure 4:
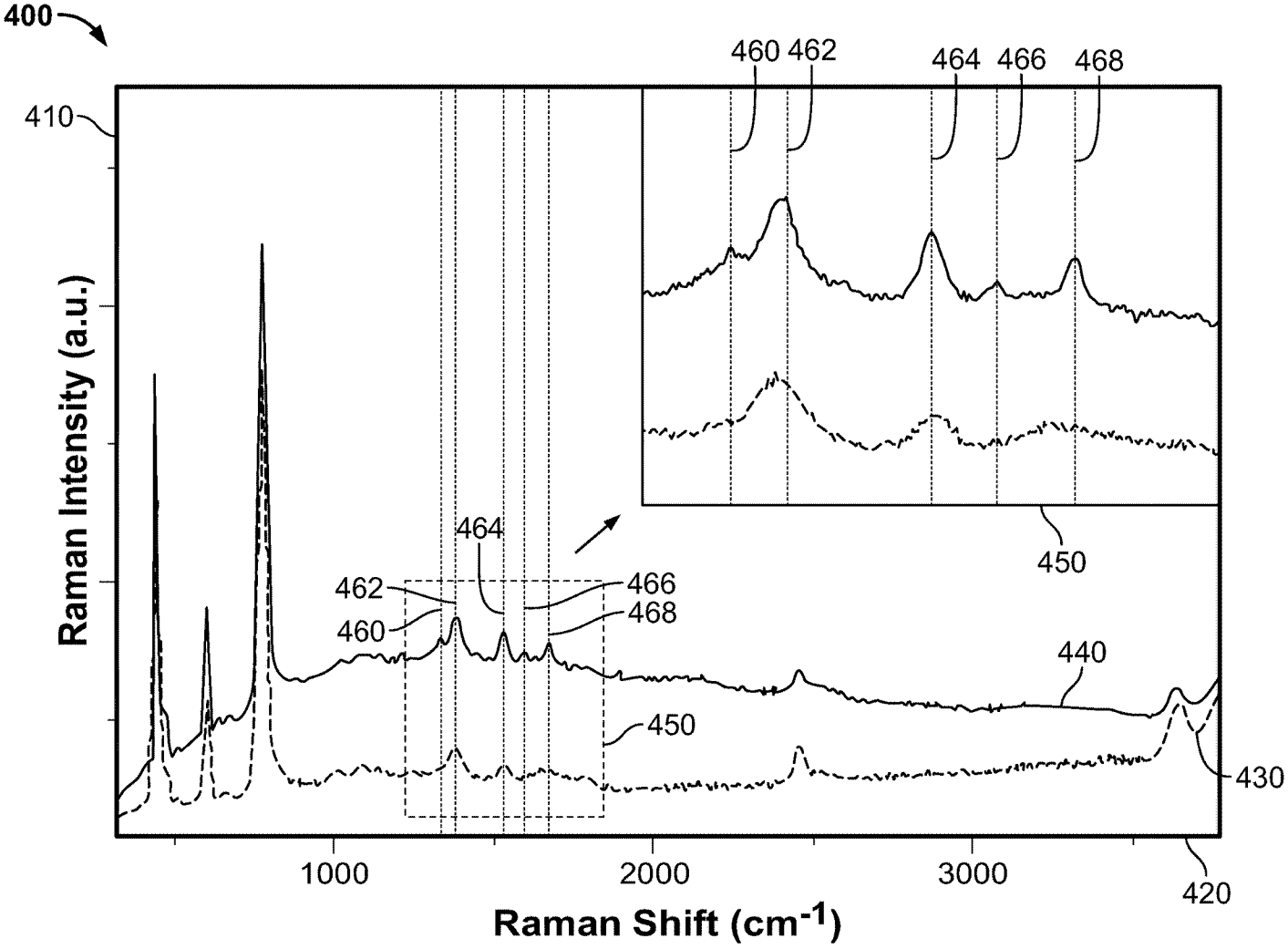
FIG. 4 presents the SERS spectra of water and $10^{-5}$ M R6G solution using the SERS-active NSOF/AAO sensing platform of FIG. 3 after annealing at 500° C. for 5 min, according to an embodiment of the present invention.

It will be known to those of skill in the art that silver nanoparticles are prone to coalesce into single large particles at high temperatures, thereby greatly reducing SERS activity. FIG. 4 presents a graph 400 demonstrating the performance of the exemplary NSOF/AAO sensing platform based on evanescent-field SERS even at such elevated temperatures by illustrating the performance of an exemplary sensing platform after it has been annealed at 500° C. for 5 minutes. As was the case for the graph 300 of FIG. 3, the graph 400 plots Raman intensity, in a.u., along a vertical axis 410 against Raman shift, in $cm^{-1}$, along a horizontal axis 420. The graph 400 includes a baseline SERS spectrum of water 430 that may be measured by the exemplary annealed NSOF/AAO sensing platform. The graph 400 also includes a spectrum 440 that may be measured by the exemplary annealed NSOF/AAO sensing platform when immersed in an aqueous solution of R6G at $10^{-5}$M. The graph 400 also includes an inset 450 detailing a region noted in the main body of the graph 400. As noted above with reference to FIG. 3, it will be known to those of skill in the art that peaks at 1314, 1363, 1512, 1569, 1652 $cm^{-1}$, represented in the graph 400 and the inset 450 by lines 460, 462, 464, 466 and 468, respectively, are associated with characteristic aromatic C—C stretching vibrations of R6G molecules FIG. 4 demonstrates that, using the exemplary NSOF/AAO sensing platform described above, the R6G signature peaks may clearly be seen even after annealing. The nanoporous structure of the AAO cladding significantly hinders the fusion of silver nanoparticles into single large particles, thereby effectively preserving the SERS enhancement at elevated temperatures. The baseline spectrum 430, in contrast, is suggestive of an SERS signal from water, and displays the same peaks shown in the baseline plot 330 shown in FIG. 3. Thus, FIG. 4 also demonstrates that no new peaks are generated after the nanoscale functionalization and annealing process.

Figure 5:
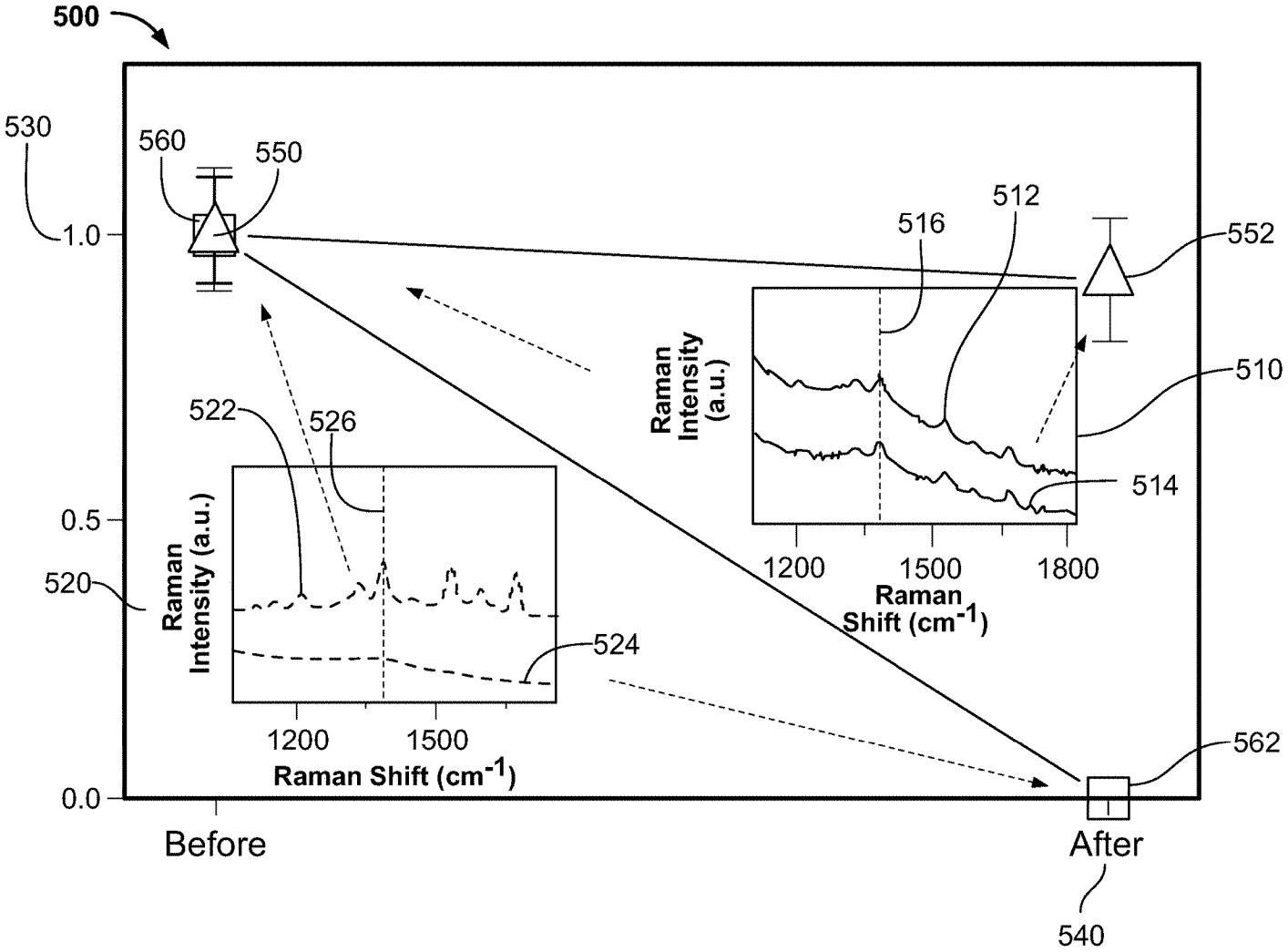
FIG. 5 presents the SERS spectra of SERS-active unclad sapphire fiber and an exemplary SERS-active NSOF/AAO sensing platform, fabricated via in situ growth of Ag nanoparticles in AAO cladding, before and after annealing.

FIG. 5 illustrates results demonstrating the thermal stability of an exemplary SERS-active AAO-clad NSOF fabricated by in situ growth of silver nanoparticles, as described above with reference to FIG. 2, as compared to an SERS-active unclad sapphire fiber with immobilized silver nanoparticles fabricated by a polymer-mediated process. FIG. 5 presents a chart 500 including insets 510 and 520, which present spectra measured before and after annealing at 500° C. for six hours. Inset 510 includes spectra 512 and 514 of observed Raman intensity measured using the exemplary sensor immersed in an aqueous solution of R6G at $10^{-6}$M after and before annealing, respectively, and shifted vertically for clarity. As described above with reference to FIGS. 3 and 4, the exemplary sensor detects peaks characteristic of R6G both before and after annealing, including a peak 516 indicated by a dashed line at 1360 $cm^{-1}$. Inset 520 includes spectra 522 and 524 of measurements made before and after annealing, respectively, by the sensor described above based on unclad sapphire fiber. While the spectrum 522 showing measurements before annealing includes peaks characteristic of R6G, including a peak 526 indicated by a dashed line at 1360 $cm^{-1}$, the spectrum 524 includes no such peaks. The main body of chart 500 plots ratios along a vertical axis 530 against a horizontal axis 540 indicating performance measurements before and after annealing. The chart 500 includes a first pair of entries 550 and 552, indicated by triangles, representing the performance of the sensor of the exemplary embodiments before and after annealing, along with error bars indicating variability of the measured data. The position of the entries 550 and 552 along the vertical axis 530 represents the ratio of the Raman intensity observed for the given entry at 1360 $cm^{-1}$, which, as noted above, is characteristic of R6G, to that observed for the unannealed fiber. Thus, entry 550 is located at a value of 1.0 along the vertical axis 530, representing its ratio to itself, while entry 552 is located at a value of 0.92, indicating only a small degradation in Raman sensitivity after annealing. Entries 560 and 562 represent the performance of the unclad sensor described above before and after annealing, along with error bars for entry 560 indicating variability of the measured data. Entry 560, like entry 550, is located at a value of 1.0 along the vertical axis 530; entry 562, however, is located at a value of 0.0 along the vertical axis 530, indicating no Raman sensitivity in the unclad sensor after annealing.

The exemplary NSOF/AAO sensing platform described above may be suited for chemical sensing and measurements in harsh environments at high temperatures, which is an area of great scientific significance and technological impact.

It will be understood that the embodiments of the present invention described herein are merely exemplary and that a person skilled in the art may make many variations and modifications without departing from the spirit and scope of the invention. All such variations and modifications are intended to be included within the scope of the invention, as described in the following claims.

What is claimed is:

1. A method of making a sensing platform, comprising the steps of:

coating an end-polished sapphire optical fiber with aluminum to provide the sapphire optical fiber with an aluminum coating;

anodizing the aluminum thereby forming a sapphire fiber with a porous aluminum oxide coating on an outer surface of the sapphire optical fiber;

immobilizing a plurality of nanoparticles in pores of the porous aluminum oxide coating; and removing a distal portion of the porous aluminum oxide coating from the sapphire fiber, thereby exposing a distal portion of the outer surface of the sapphire optical fiber.

2. The method of claim 1, wherein the plurality of nanoparticles includes one of a plurality of silver nanoparticles, a plurality of gold nanoparticles, a plurality of platinum nanoparticles, and a plurality of palladium nanoparticles.

3. The method of claim 1, wherein the step of immobilizing the plurality of nanoparticles in pores of the porous aluminum oxide coating comprises the further steps of:

immersing the sapphire fiber with porous anodized aluminum oxide coating in a solution of polyallylamine hydrochloride;

rinsing the porous aluminum oxide coating in purified water; and immersing the with porous aluminum oxide coating in a suspension of silver nanoparticles.

4. The method of claim 3, wherein a concentration of the solution of polyallylamine hydrochloride is about 0.2 milligrams per milliliter.

5. The method of claim 3, wherein the step of immobilizing the plurality of nanoparticles in pores of the porous aluminum oxide coating comprises the further steps of:

adding a sodium citrate solution to a silver nitrate solution to produce a mixture; and exposing the mixture to ultraviolet light for a predetermined time period to produce the solution of silver nanoparticles.

6. The method of claim 5, wherein the sodium citrate solution includes 0.8 milliliter of 1% aqueous sodium citrate and wherein the silver nitrate solution includes 40 milliliters of 1 millimolar $AgNO_3$.

7. The method of claim 5, wherein the predetermined time period is about four hours, and wherein the mixture is maintained at a temperature of less than 50 degrees Celsius during the exposing step.

8. The method of claim 1, wherein the step of immobilizing the plurality of nanoparticles in pores of the porous aluminum oxide coating comprises the further steps of:

immersing the porous aluminum oxide coating in a solution of tin chloride and hydrochloric acid thereby forming tin deposits in the porous aluminum oxide coating;

immersing the porous aluminum oxide coating with the tin deposits in a solution of silver nitrate to produce silver seeds in the porous aluminum oxide coating; and immersing the porous aluminum oxide coating with the silver seeds in a solution of silver nitrate and ascorbic acid thereby forming silver nanoparticles in the porous anodized aluminum oxide coating.

9. The method of claim 8, wherein the steps of immersing the porous aluminum oxide coating in a solution of tin chloride and hydrochloric acid and immersing the porous aluminum oxide coating with the tin deposits in a solution of silver nitrate constitute a deposition cycle, and wherein the deposition cycle is repeated for a plurality of deposition cycles prior to performing the step of immersing the porous anodized aluminum oxide coating with the silver seeds in a solution of silver nitrate and ascorbic acid.

10. The method of claim 9, wherein the plurality of deposition cycles comprises five deposition cycles.

11. The method of claim 1, further including the step of selecting a parameter of the anodizing step to control at least one of a size of pores in the porous anodized aluminum oxide coating, a depth of pores in the porous anodized aluminum oxide coating, and an interpore distance between pores in the porous anodized aluminum oxide coating.

12. The method of claim 11, wherein the parameter includes one or both of a pH of an electrolyte solution used for the anodizing step and a voltage applied to an electrolyte solution used for the anodizing step.

13. The method of claim 1, wherein the step of coating the end-polished sapphire fiber includes the further step of dip-coating the end-polished sapphire fiber in liquid aluminum.

14. The method of claim 13, wherein the dip-coating step is performed under an inert atmosphere.

15. The method of claim 1, wherein the anodizing step is performed in an acidic electrolyte solution under an applied voltage.

16. The method of claim 1, wherein the step of removing the distal end of the porous aluminum oxide coating comprises dipping the distal end of the porous aluminum oxide coating in an acidic solution.

* * * * *